US006336331B1

(12) United States Patent
White et al.

(10) Patent No.: US 6,336,331 B1
(45) Date of Patent: Jan. 8, 2002

(54) SYSTEM FOR OPERATING CRYOGENIC LIQUID TANKAGE

(75) Inventors: Norman Henry White, East Amherst; Kenneth Kai Wong, Amherst; William Martin Greene, III, East Amherst; Dante Patrick Bonaquist, Grand Island; Arun Acharya, East Amherst; Bayram Arman, Grand Island, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/629,870

(22) Filed: Aug. 1, 2000

(51) Int. Cl.[7] ..... F17C 3/10
(52) U.S. Cl. ..... 62/48.2; 62/3.1; 62/6
(58) Field of Search ..... 62/48.2, 6, 3.1

(56) References Cited

U.S. PATENT DOCUMENTS 2,944,405 A * 7/1960 Basore et al. ..... 62/48.2
2,978,876 A * 4/1961 Pastuhov ..... 62/48.2
3,319,432 A * 5/1967 Negben ..... 62/48.2
3,413,814 A * 12/1968 Van Geuns ..... 62/3.1
4,211,085 A 7/1980 Tyree, Jr. ..... 62/48
4,727,722 A * 3/1988 Kirol ..... 62/3.1
5,477,691 A 12/1995 White ..... 62/50.2
5,520,000 A 5/1996 Pevzner ..... 62/48.1
5,537,828 A 7/1996 Borcuch et al. ..... 62/50.1
5,941,081 A 8/1999 Burgener ..... 62/50.1
5,983,646 A * 11/1999 Grothe et al. ..... 62/6

* cited by examiner

*Primary Examiner*—Ronald Capossela
(74) *Attorney, Agent, or Firm*—Stanley Ktorides

(57) ABSTRACT

A system wherein flashoff losses from cryogenic liquid tankage are reduced wherein fluid from the tankage is condensed and subcooled against refrigeration bearing refrigerant fluid generated by an exogenous refrigeration system.

12 Claims, 3 Drawing Sheets

SYSTEM FOR OPERATING CRYOGENIC LIQUID TANKAGE

TECHNICAL FIELD

This invention relates generally to the operation of cryogenic tankage and is particularly useful for reducing flash off losses from cryogenic liquid stored in such tankage.

BACKGROUND ART

Cryogenic liquids, such as liquid argon, are transported from production facilities to the point of consumption. Losses of the cryogen are incurred as a result of heat leak into the cryogenic liquid during transportation as well as transfer of liquid into, and storage of liquid within, a storage facility near the point of consumption. The heat leak causes evaporation of some of the cryogenic liquid resulting in a pressure increase within the container to the point at which the vapor is vented to the atmosphere through safety valves. The heat leak into the cryogenic liquid not only causes some of the cryogenic liquid to vaporize, but also results in the liquid becoming warmer thus increasing flash off losses when the cryogenic liquid is passed from the storage facility to the use point.

Those skilled in the art have addressed this problem by using a relatively less expensive cryogenic liquid to condense evaporated cryogenic liquid. For example, by boiling liquid nitrogen against gaseous argon that evaporated because of heat leak, the argon is condensed and thereby recovered. The evaporated nitrogen is then vented to the atmosphere. In effect this is an exchange of relatively less expensive cryogenic liquid for a relatively more expensive cryogenic liquid. However, since liquid nitrogen, its storage and its use still entail considerable costs, the cryogenic liquid exchange method described above has shortcomings.

Accordingly, it is an object of this invention to provide an improved system for refrigerating the contents of tankage containing cryogenic liquid in order to reduce losses resulting from heat leak into the tankage.

SUMMARY OF THE INVENTION

The above and other objects, which will become apparent to those skilled in the art upon a reading of this disclosure, are attained by the present invention, one aspect of which is:

A method for refrigerating the contents of tankage containing cryogenic liquid comprising:

(A) providing tankage containing vapor and cryogenic liquid, and passing vapor from the tankage to a heat exchanger;

(B) condensing at least some of the vapor within the heat exchanger by indirect heat exchange with refrigeration bearing refrigerant fluid to produce condensed vapor;

(C) subcooling the condensed vapor by indirect heat exchange with the refrigeration bearing refrigerant fluid to produce cryogenic liquid; and (D) passing subcooled cryogenic liquid from the heat exchanger to the tankage.

Another aspect of the invention is:

Apparatus for refrigerating the contents of tankage containing cryogenic liquid comprising:

(A) tankage comprising at least one tank, a heat exchanger, and means for passing vapor from the tankage to the heat exchanger;

(B) a refrigeration system comprising means for producing a refrigeration bearing refrigerant fluid;

(C) means for passing refrigeration bearing refrigerant fluid from the refrigeration system to the heat exchanger; and (D) means for passing fluid from the heat exchanger to the tankage.

As used herein, the term "indirect heat exchange" means the bringing of two fluids into heat exchange relation without any physical contact or intermixing of the fluids with each other.

As used herein, the term "expansion" means to effect a reduction in pressure.

As used herein, the term "expansion device" means apparatus for effecting expansion of a fluid.

As used herein, the term "compression" means to effect an increase in pressure.

As used herein, the term "compressor" means apparatus for effecting compression of a fluid.

As used herein, the term "multicomponent refrigerant fluid" means a fluid comprising two or more species and capable of generating refrigeration.

As used herein, the term "variable load refrigerant" means a mixture of two or more components in proportions such that the liquid phase of those components undergoes a continuous and increasing temperature change between the bubble point and the dew point of the mixture. The bubble point of the mixture is the temperature, at a given pressure, wherein the mixture is all in the liquid phase but addition of heat will initiate formation of a vapor phase in equilibrium with the liquid phase. The dew point of the mixture is the temperature, at a given pressure, wherein the mixture is all in the vapor phase but extraction of heat will initiate formation of a liquid phase in equilibrium with the vapor phase. Hence, the temperature region between the bubble point and the dew point of the mixture is the region wherein both liquid and vapor phases coexist in equilibrium. In the preferred practice of this invention the temperature differences between the bubble point and the dew point for a variable load refrigerant generally is at least 10° C., preferably at least 20° C. and most preferably at least 50° C.

As used herein, the term "subcooling" means cooling a liquid to be at a temperature lower than the saturation temperature of that liquid for the existing pressure.

DETAILED DESCRIPTION

Figure 1:
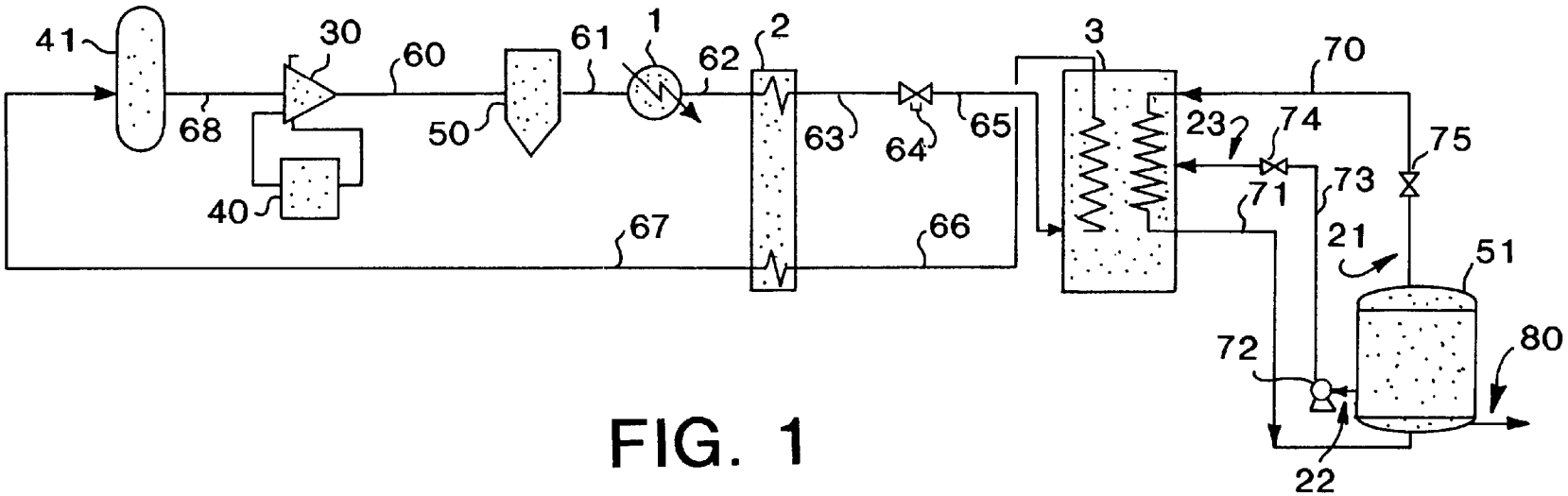
FIG. 1 is a schematic representation of one particularly preferred embodiment of the cryogenic liquid tankage operating system of this invention wherein refrigeration is supplied using a vapor compression system.

The invention will be described in detail with reference to the Drawings. Referring now to FIG. 1, tankage 51 contains vapor and cryogenic liquid. In FIG. 1 tankage 51 is illustrated as being a single tank and as being stationary. In the practice of this invention the tankage could comprise a plurality of individual tanks, preferably in flow communication through piping. In the practice of this invention the tank could be mobile, e.g. could be mounted on a trailer of a tractor-trailer system or a railway tank car, on which is also mounted the refrigeration system which will be described below.

Among the cryogenic liquids which may be used in the practice of this invention, one can name argon, oxygen, nitrogen, hydrogen, helium, neon, krypton, xenon, natural gas, liquefied petroleum gas, hydrocarbons, fluoroethers, fluorocarbons, and nitrous oxide, as well as mixtures containing one or more thereof.

Vapor is withdrawn from the upper portion of the single tank of tankage 51 in stream 21, passed through valve 75 and then as stream 70 to heat exchanger 3. If desired, heat exchanger 3 could be located within tank 51. As the vapor in stream 70 is passed through heat exchanger 3, it is at least partially, preferably completely, condensed by indirect heat exchange, preferably countercurrent indirect heat exchange, with refrigeration bearing refrigerant fluid as will be more fully described below and is then subcooled by indirect heat exchange with the refrigeration bearing refrigerant fluid. The resulting subcooled cryogenic liquid is then withdrawn from heat exchanger 3 in stream 71 and then returned to the tankage. In the case where the tankage comprises more than one individual tank, the subcooled cryogenic liquid could be returned to the same tank from which the vapor is withdrawn, and/or it could be passed into a different tank.

FIG. 1 illustrates a particularly preferred embodiment of the invention wherein, in addition, cryogenic liquid is withdrawn from tank 51 and is itself subcooled by indirect heat exchange with the refrigeration bearing refrigerant fluid. In the particular example of this embodiment illustrated in FIG. 1, cryogenic liquid is withdrawn from tankage 51 in stream 22, passed through liquid pump 72 and then as stream 73 to valve 74 and as stream 23 into heat exchanger 3 at a colder point of the heat exchanger than where vapor stream 70 is passed into the heat exchanger. Preferably, as illustrated in FIG. 1, stream 23 is combined with stream 70 within heat exchanger 3. The cryogenic liquid within stream 23 is subcooled by passage through the cold leg of heat exchanger 3 by indirect heat exchange with refrigeration bearing refrigerant fluid and then returned to the tankage. In the embodiment illustrated in FIG. 1, the subcooled cryogenic liquid is returned to tankage 51 in stream 71. If desired, two or more cryogenic liquid streams, preferably taken from different levels of the tankage, may be subcooled by indirect heat exchange with the refrigeration bearing refrigerant fluid. The cryogenic liquid is withdrawn from tank 51 in stream 80 for passage to a use point.

Refrigerant fluid 68 is compressed by passage through compressor 30 to form compressed refrigerant fluid 60. Oil removal system 40 removes compressor lubricant from the refrigerant fluid and returns it to compressor 30. Final oil removal is completed by oil separator 50. The resulting compressed refrigerant fluid 61 is then cooled of the heat of compression in cooler 1 by indirect heat exchange with a cooling fluid such as air or water, and resulting cooled refrigerant fluid 62 is further cooled by passage through precooler or heat exchanger 2 in indirect heat exchange with returning refrigerant fluid. The resulting cooled compressed refrigerant fluid 63 is then expanded through an expansion device to generate refrigeration. In the embodiment of the invention illustrated in FIG. 1 the expansion device is Joule-Thompson throttle valve 64. Resulting refrigeration bearing refrigerant fluid 65 is then passed through heat exchanger 3 wherein it is warmed to effect the condensing of vapor and subcooling of liquid from tankage 51 as was previously described. Generally the refrigerant fluid entering heat exchanger 3 is mostly or all in liquid form and, upon exiting heat exchanger 3, is generally a two phase fluid. Two phase refrigerant fluid 66 is passed to precooler 2 wherein it is heated and generally completely vaporized by indirect heat exchange with cooling refrigerant fluid 62 as was previously described. Resulting warmed refrigerant fluid is passed in stream 67 from precooler heat exchanger 2 to surge tank 41 and from surge tank 41 is passed to compressor 30 in stream 68 and the refrigeration cycle starts anew.

Any useful refrigerant fluid may be used in the practice of this invention. Preferably the refrigerant fluid used in the practice of this invention is a multicomponent refrigerant fluid which is capable of more efficiently delivering refrigeration at different temperature levels. The use of a multicomponent refrigerant fluid is particularly preferred in systems, such as the system illustrated in FIG. 1, where both vapor and liquid is provided from the tankage to the heat exchanger. When a multicomponent refrigerant fluid is used in the practice of this invention it preferably comprises at least two species from the group consisting of fluorocarbons, hydrofluorocarbons, hydrochlorofluorocarbons, fluoroethers, hydrofluoroethers, atmospheric gases and hydrocarbons, e.g. the multicomponent refrigerant fluid could be comprised only of two fluorocarbons. Preferably the multicomponent refrigerant useful in the practice of this invention is a variable load refrigerant.

Another multicomponent refrigerant fluid useful with this invention preferably comprises at least one component from the group consisting of fluorocarbons, hydrofluorocarbons, fluoroethers, and hydrofluoroethers, and at least one component from the group consisting of fluorocarbons, hydrofluorocarbons, hydrochlorofluorocarbons, fluoroethers, hydrofluoroethers, atmospheric gases and hydrocarbons.

Another preferred multicomponent refrigerant fluid useful with this invention comprises at least two components from the group consisting of fluorocarbons, hydrofluorocarbons, fluoroethers and hydrofluoroethers and at least one component from the group consisting of fluorocarbons, hydrofluorocarbons, hydrochlorofluorocarbons, fluoroethers, hydrofluoroethers, atmospheric gases and hydrocarbons.

In one preferred embodiment of the invention the multicomponent refrigerant fluid consists solely of fluorocarbons. In another preferred embodiment of the invention the multicomponent refrigerant fluid consists solely of fluorocarbons and hydrofluorocarbons. In another preferred embodiment of the invention the multicomponent refrigerant fluid consists solely of fluorocarbons, fluoroethers, hydrofluoroethers and atmospheric gases. Most preferably every component of the multicomponent refrigerant fluid is either a fluorocarbon, hydrofluorocarbon, fluoroether, hydrofluoroether or atmospheric gas.

Figure 2:
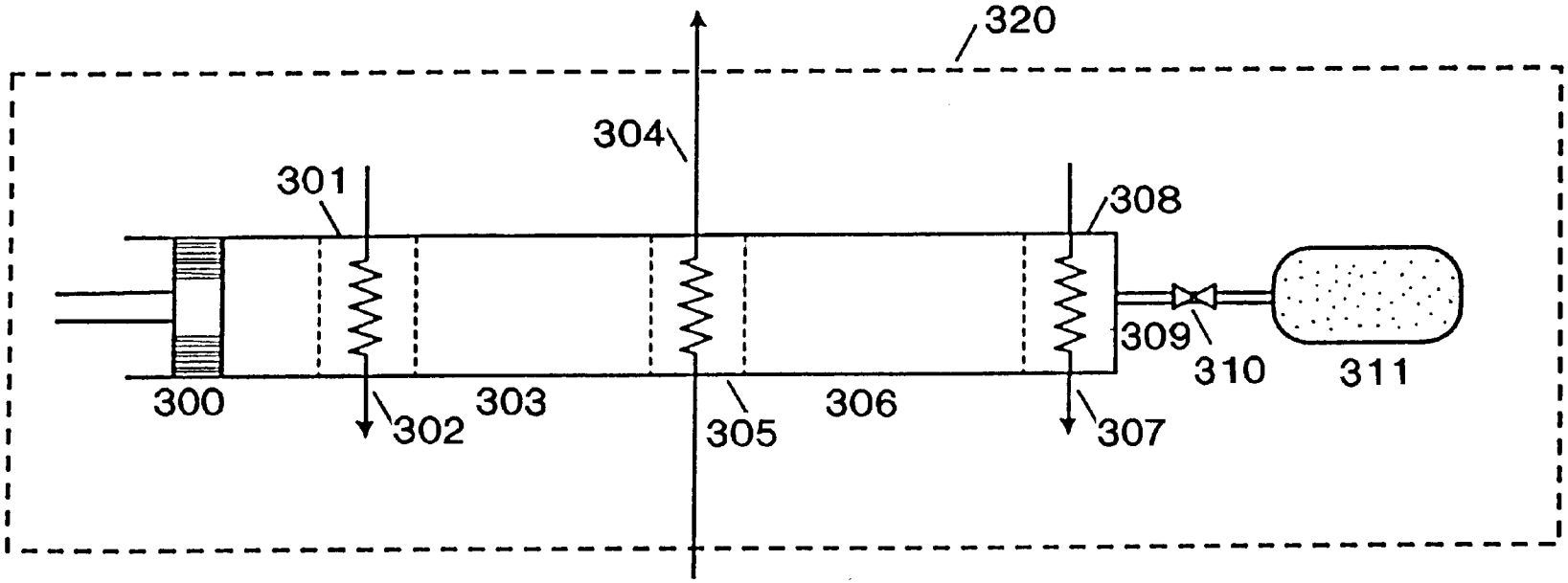
FIG. 2 is a representation of a pulse tube system for generating the refrigeration bearing refrigerant fluid for the practice of this invention.
Figure 3:
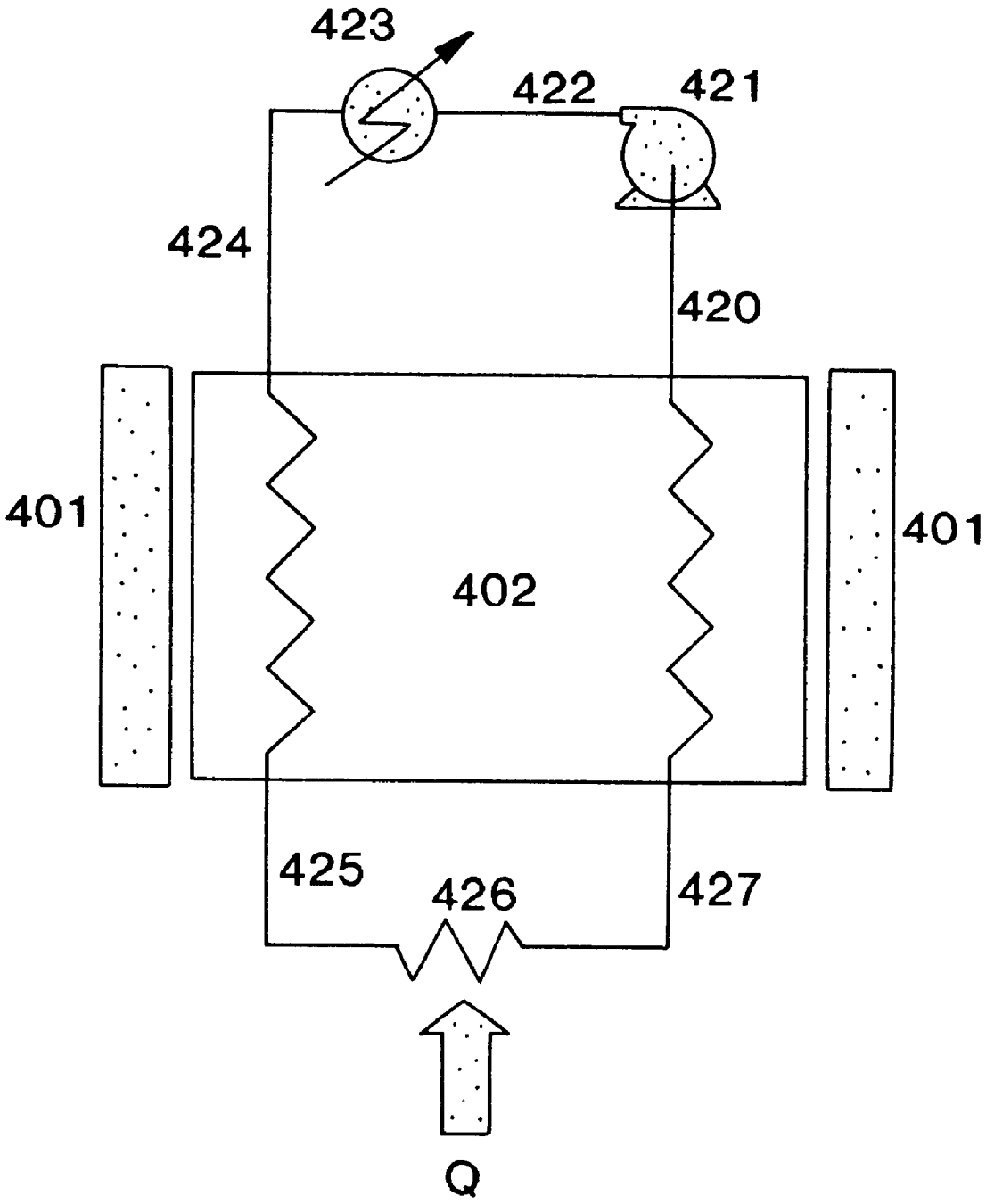
FIG. 3 is a representation of a magnetic refrigeration system for generating the refrigeration bearing refrigerant fluid for the practice of this invention.

In addition to the vapor compression refrigeration system illustrated in FIG. 1 for producing the refrigeration bearing refrigerant fluid for use in the operating system of this invention, the refrigeration bearing refrigerant fluid may also be produced using a pulse tube system illustrated in FIG. 2 or a magnetic refrigeration system illustrated in FIG. 3.

Referring now to FIG. 2, the basic orifice pulse tube refrigerator 320 is a closed refrigeration system that pulses a refrigerant in a closed cycle and in so doing transfers a heat load from a cold section to a hot section. The frequency and phasing of the pulses is determined by the configuration of the system. The motion of the gas is generated by a piston of a compressor or some other acoustic-wave generation device 300 to generate a pressure wave within the volume of gas. The compressed gas flows through an aftercooler 301, which removes the heat of compression into fluid 302. The compressed refrigerant then flows through the regenerator section 303 cooling as it passes through. The regenerator precools the incoming high-pressure working fluid before it reaches the cold end. The working fluid enters the cold heat exchanger 305 then pulse tube 306, and compresses the fluid residing in the pulse tube towards the hot end of the pulse tube. The warmer compressed fluid within the warm end of the pulse tube passes through the hot heat exchanger 308 and then into the reservoir 311 through piping 309. The gas motion, in phase with the pressure, is accomplished by incorporating an orifice 310 and a reservoir volume where the gas is stored during a half cycle. The size of the reservoir 311 is sufficient so that essentially no pressure oscillation occurs in it during the oscillating flow. The oscillating flow through the orifice causes a separation of the heating and cooling effects. The inlet flow from the wave-generation device/piston 300 stops and the tube pressure decreases to a lower pressure. Gas from the reservoir 311 at an average pressure cools as it passes through the orifice to the pulse tube, which is at the lower pressure. The gas at the cold end of the pulse tube 306 is adiabatically cooled below to extract heat from the cold heat exchanger. The lower pressure working fluid is warmed within regenerator 303 as it passes into the wave-generating device/piston 300. Heat is removed into fluid 307. Fluid 304, which is used as the refrigeration bearing refrigerant fluid for the practice of this invention, is cooled as illustrated by passage through cold heat exchanger 305.

The orifice pulse tube refrigerator functions ideally with adiabatic compression and expansion in the pulse tube. The cycle is as follows: The piston first compresses the gas in the pulse tube. Since the gas is heated, the compressed gas is at a higher pressure than the average pressure in the reservoir, it flows through the orifice into the reservoir and exchanges heat with the ambient through the heat exchanger located at the warm end of the pulse tube. The flow stops when the pressure in the pulse tube is reduced to the average pressure. The piston moves back and expands the gas adiabatically in the pulse tube. The cold, low-pressure gas in the pulse tube is forced toward the cold end by the gas flow from the reservoir into the pulse tube through the orifice. As the cold refrigerant passes through the heat exchanger at the cold end of the pulse tube it removes the heat from the fluid being cooled. The flow stops when the pressure in the pulse tube increases to the average pressure. The cycle is then repeated.

The refrigeration may also be generated using magnetic or active magnetic refrigeration systems. A magnetic refrigerator employs adiabatic demagnetization to provide low temperature refrigeration. Although the temperature span of refrigeration is limited for any given magnetic material, a large temperature span may be attained using a series of magnetic materials in an active magnetic regenerator configuration.

FIG. 3 shows a schematic for the coupling of a magnetic refrigeration system. Heat transfer fluid 420 being recirculated by pump or compressor 421 as stream 422 is cooled of the heat of compression by passage through cooler 423 and then as stream 424 is passed through the active magnetic refrigeration system 402 where it is cooled down to produce stream 425. The stream 425 warms up in exchanger 426 and returns to the active magnetic refrigeration system as stream 427. Stream 425 picks up the heat load Q from refrigerant fluid which could be gaseous refrigerant such as helium or liquid refrigerant such as fluorocarbons, or phase changing refrigerant such as nitrogen, argon. The refrigerant, after being cooled in heat exchanger 426, is the refrigeration bearing refrigerant fluid used in the operating system of this invention. Bed 402 is magnetized and demagnetized periodically by moving the bed in and out of a magnetic field by moving magnet 401 or turning magnet 401 on or off.

Although the invention has been described in detail with reference to certain preferred embodiments, those skilled in the art will recognize that these are other embodiments of the invention within the spirit and the scope of the claims.

What is claimed is:

1. A method for refrigerating the contents of tankage containing cryogenic liquid comprising:

(A) providing tankage containing vapor and cryogenic liquid, and passing vapor from the tankage to a heat exchanger;

(B) condensing at least some of the vapor within the heat exchanger by indirect heat exchange with refrigeration bearing refrigerant fluid to produce condensed vapor;

(C) subcooling the condensed vapor by indirect heat exchange with the refrigeration bearing refrigerant fluid to produce cryogenic liquid; and (D) passing subcooled cryogenic liquid from the heat exchanger to the tankage at a level where the tankage contains cryogenic liquid.

2. The method of claim 1 wherein the refrigerant fluid is a multicomponent refrigerant fluid.

3. The method of claim 1 further comprising passing cryogenic liquid from the tankage to the heat exchanger, subcooling the cryogenic liquid by indirect heat exchange with refrigeration bearing refrigerant fluid to produce additional subcooled cryogenic liquid, and passing the additional subcooled cryogenic liquid from the heat exchanger to the tankage.

4. The method of claim 1 wherein the refrigeration bearing refrigerant fluid is produced by compressing a refrigerant fluid, cooling the compressed refrigerant fluid, expanding the cooled compressed refrigerant fluid to generate refrigeration, and passing the resulting refrigeration bearing refrigerant fluid to the heat exchanger.

5. The method of claim 1 wherein the refrigeration bearing refrigerant fluid is produced using a pulse tube arrangement wherein a working fluid is compressed by a pulse, expanded to reduce its temperature, and used to cool a fluid which becomes the refrigeration bearing refrigerant fluid for passage to the heat exchanger.

6. The method of claim 1 wherein the refrigeration bearing refrigerant fluid is produced using a magnetic refrigeration system wherein a working fluid is cooled by passage through a bed of magnetizable particles and used to cool a fluid which becomes the refrigeration bearing refrigerant fluid for passage to the heat exchanger.

7. Apparatus for refrigerating the contents of tankage containing cryogenic liquid comprising:

(A) tankage comprising at least one tank containing vapor and cryogenic liquid, a heat exchanger, and means for passing vapor from the tankage to the heat exchanger;

(B) a refrigeration system comprising means for producing a refrigeration bearing refrigerant fluid;

(C) means for passing refrigeration bearing refrigerant fluid from the refrigeration system to the heat exchanger; and (D) means for passing fluid from the heat exchanger to the tankage at a level where the tankage contains cryogenic liquid.

8. The apparatus of claim 7 wherein the tankage comprises a single tank.

9. The apparatus of claim 7 further comprising means for passing liquid from the tankage to the heat exchanger.

10. The apparatus of claim 7 wherein the refrigeration system comprises a compressor, a precooler, an expansion device, means for passing refrigerant fluid to the compressor, means for passing refrigerant fluid from the compressor to the precooler, and means for passing refrigerant fluid from the precooler to the expansion device to produce refrigeration bearing refrigerant fluid.

11. The apparatus of claim 7 wherein the refrigeration system comprises a pulse tube arrangement having a pulse tube containing working fluid, means for providing a pulse to the working fluid and means for warming the working fluid by indirect heat exchange with refrigerant fluid to produce refrigeration bearing refrigerant fluid.

12. The apparatus of claim 7 wherein the refrigeration system comprises a magnetic refrigeration system having a bed of magnetizable particles, means for periodically magnetizing and demagnetizing the bed, means for passing working fluid through the bed, and means for warming the working fluid by indirect heat exchange with refrigerant fluid to produce refrigeration bearing refrigerant fluid.

* * * * *